US008443843B2

(12) United States Patent
Mount et al.

(10) Patent No.: US 8,443,843 B2
(45) Date of Patent: May 21, 2013

(54) AIR-OIL SEPARATOR

(75) Inventors: James Kevin Mount, Cincinnati, OH (US); Richard Walker Nicholson, Cincinnati, OH (US); Duane Howard Anstead, Fairfield, OH (US); Robert Proctor, West Chester, OH (US); Pradeep Hemant Sangli, Bangalore (IN); Prasad Laxman Kane, Pune (IN); Mark Leonard Hopper, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/617,462

(22) Filed: Sep. 14, 2012

(65) Prior Publication Data

US 2013/0031882 A1 Feb. 7, 2013

Related U.S. Application Data

(62) Division of application No. 11/946,103, filed on Nov. 28, 2007, now Pat. No. 8,292,034.

(51) Int. Cl.
*F16L 55/10* (2006.01)

(52) U.S. Cl.
USPC ..... 138/89; 138/90

(58) Field of Classification Search
USPC ..... 138/89, 90, 96 T, 96 R; 137/583, 137/587; 220/366.1, 274; 184/6.11; 60/39.08
See application file for complete search history.

(56) References Cited

U.S. PATENT DOCUMENTS

| | | | | |
|---|---|---|---|---|
| 3,454,182 | A * | 7/1969 | Morton | 220/374 |
| 4,714,139 | A | 12/1987 | Lorenz et al. | |
| 4,755,103 | A | 7/1988 | Streifinger | |
| 4,986,502 | A * | 1/1991 | Ceroke | 251/216 |
| 5,201,845 | A | 4/1993 | Allmon et al. | |
| 5,747,904 | A | 5/1998 | Sudhoff | |
| 5,776,229 | A | 7/1998 | Blanes | |
| 6,033,450 | A | 3/2000 | Krul et al. | |
| 6,398,833 | B1 | 6/2002 | Santerre et al. | |
| 6,513,332 | B2 * | 2/2003 | Care et al. | 60/772 |

(Continued)

FOREIGN PATENT DOCUMENTS

| | | |
|---|---|---|
| FR | 2696655 | 4/1994 |
| JP | 2003-161113 A | 6/2003 |

OTHER PUBLICATIONS

Office Action from corresponding Japanese Patent Application No. 2008-300306, dated Oct. 16, 2012.

(Continued)

*Primary Examiner* — Patrick F Brinson
(74) *Attorney, Agent, or Firm* — General Electric Company; William Scott Andes; Matthew P. Hayden

(57) ABSTRACT

The present invention provides an air-oil separator comprising a first region having a mixture of air and oil, a second region wherein separation of at least some of the oil from the air-oil mixture occurs and at least one multi-directional injector plug located on a rotating component in flow communication with the first region and the second region, the multi-directional injector plug having a discharge head that is oriented such that at least a part of the air-oil mixture discharged therefrom has a component of velocity that is tangential to the direction of rotation of the rotating component.

8 Claims, 5 Drawing Sheets

U.S. PATENT DOCUMENTS

| | | | | |
|---|---|---|---|---|
| 6,640,933 | B2 | 11/2003 | Henry et al. | |
| 6,705,349 | B2 | 3/2004 | Themudo et al. | |
| 6,996,968 | B2 | 2/2006 | Peters et al. | |
| 7,063,734 | B2 | 6/2006 | Latulipe et al. | |
| 7,124,857 | B2 | 10/2006 | Gekht et al. | |
| 7,566,356 | B2 | 7/2009 | Latulipe et al. | |
| 7,993,425 | B2 * | 8/2011 | Corattiyil et al. | 55/406 |
| 8,292,034 | B2 * | 10/2012 | Mount et al. | 184/6.11 |
| 8,372,173 | B2 * | 2/2013 | Martens | 55/337 |
| 2003/0010572 | A1 | 1/2003 | Henry et al. | |
| 2005/0211093 | A1 | 9/2005 | Latulipe et al. | |
| 2006/0248865 | A1 | 11/2006 | Latulipe et al. | |
| 2009/0133581 | A1 * | 5/2009 | Fang et al. | 96/216 |

OTHER PUBLICATIONS

Office Action from corresponding Japanese Patent Application No. 2008-300307, dated Oct. 16, 2012.

* cited by examiner

AIR-OIL SEPARATOR

CROSS REFERENCE TO RELATED APPLICATIONS

This application is a divisional of U.S. Ser. No. 11/946,103, filed on Nov. 28, 2007, the entire disclosure of which is incorporated herein by reference.

BACKGROUND OF THE INVENTION

This invention relates generally to gas turbine engines and more particularly to an air oil separator for recovering oil used to lubricate and cool the bearings of a gas turbine engine.

Gas turbine engines typically include a core having a compressor for compressing air entering the core, a combustor where fuel is mixed with the compressed air and then burned to create a high energy gas stream, and a high pressure turbine which extracts energy from the gas stream to drive the compressor. In aircraft turbofan engines, a low pressure turbine located downstream from the core extracts more energy from the gas stream for driving a fan. The fan usually provides the main propulsive thrust generated by the engine.

Bearings are used in the engine to accurately locate and rotatably mount rotors with respect to stators in the compressor and high and low pressure turbines of the engine. The bearings are enclosed in oil-wetted portions of the engine called sumps.

In order to prevent overheating of the bearings, lubricating oil and seals must be provided to prevent the hot air in the engine flowpath from reaching the bearing sumps, and lubricating oil flows must be sufficient to carry away heat generated internally by the bearings because of their high relative speed of rotation.

Oil consumption arises from the method used to seal the engine sumps. The sealing method makes it necessary for an air flow circuit to exist that flows into and out of the sumps. This flow ultimately contains oil that is unrecoverable unless adequately separated and delivered back to the sumps. In one particular configuration the forward engine sump is vented through the forward fan shaft and out of the engine through a center vent tube. Once the air/oil mixture exits the sump, it swirls, depositing oil on the inside of the fan shaft. Oil that is contained in the air/oil mixture is lost when it is unable to centrifuge back into the sump through the vent hole due to rapidly escaping vent air.

Some conventional designs allow for oil recovery by using weep holes, which are passages whose function is to provide a dedicated path for oil to re-enter the sump, integrated into the forward fan shaft design. In other conventional designs, the fan shaft has no dedicated weep holes, only vent holes. Some conventional designs use a weep plug in a rotating shaft that injects the air-oil mixture radially into a chamber for separating the oil and air, and routes the separated oil through a passage in the weep plug. The weep plug allows the air-oil mixture to radially enter a separator cavity through a central passage in the weep plug. As the air-oil mixture swirls down to a lower radius centrifugal forces drive the more massive oil particles back to the inside diameter of the shaft, while the air escapes through the vent exit. However, air-oil separation is very poor in these conventional designs in cases where the axial distances are short between the radial entrance locations and the air vent entrances. Due to the high radial momentum of the air-oil mixture entering the chamber through the vent holes or the weep plugs, and the short axial distance to the vent exit, the dwell time for vortex motion of the air-oil mixture is short. It has been found that without adequate dwell time for vortex motion, oil separation from the air-oil mixture will be poor.

It is desirable to have an air-oil separator system that reduces the radial momentum and increases tangential momentum of the air-oil mixture. It is desirable to have an air-oil separator which is effective in removing oil in engine systems which have sumps that are axially short. It is desirable to have a method to recover oil more efficiently in existing sump structures without modifying the existing hardware.

BRIEF DESCRIPTION OF THE INVENTION

The above-mentioned need may be met by an air-oil separator comprising a first region having a mixture of air and oil, a second region wherein separation of at least some of the oil from the air-oil mixture occurs and at least one multi-directional injector plug located on a rotating component in flow communication with the first region and the second region, the multi-directional injector plug having a discharge head that is oriented such that at least a part of the air-oil mixture discharged therefrom has a component of velocity that is tangential to the direction of rotation of the rotating component.

BRIEF DESCRIPTION OF THE DRAWINGS

The subject matter which is regarded as the invention is particularly pointed out and distinctly claimed in the concluding part of the specification. The invention, in accordance with preferred and exemplary embodiments, together with further objects and advantages thereof, is described in the following detailed description taken in conjunction with the accompanying drawings in which:

DETAILED DESCRIPTION OF THE INVENTION

Figure 1:
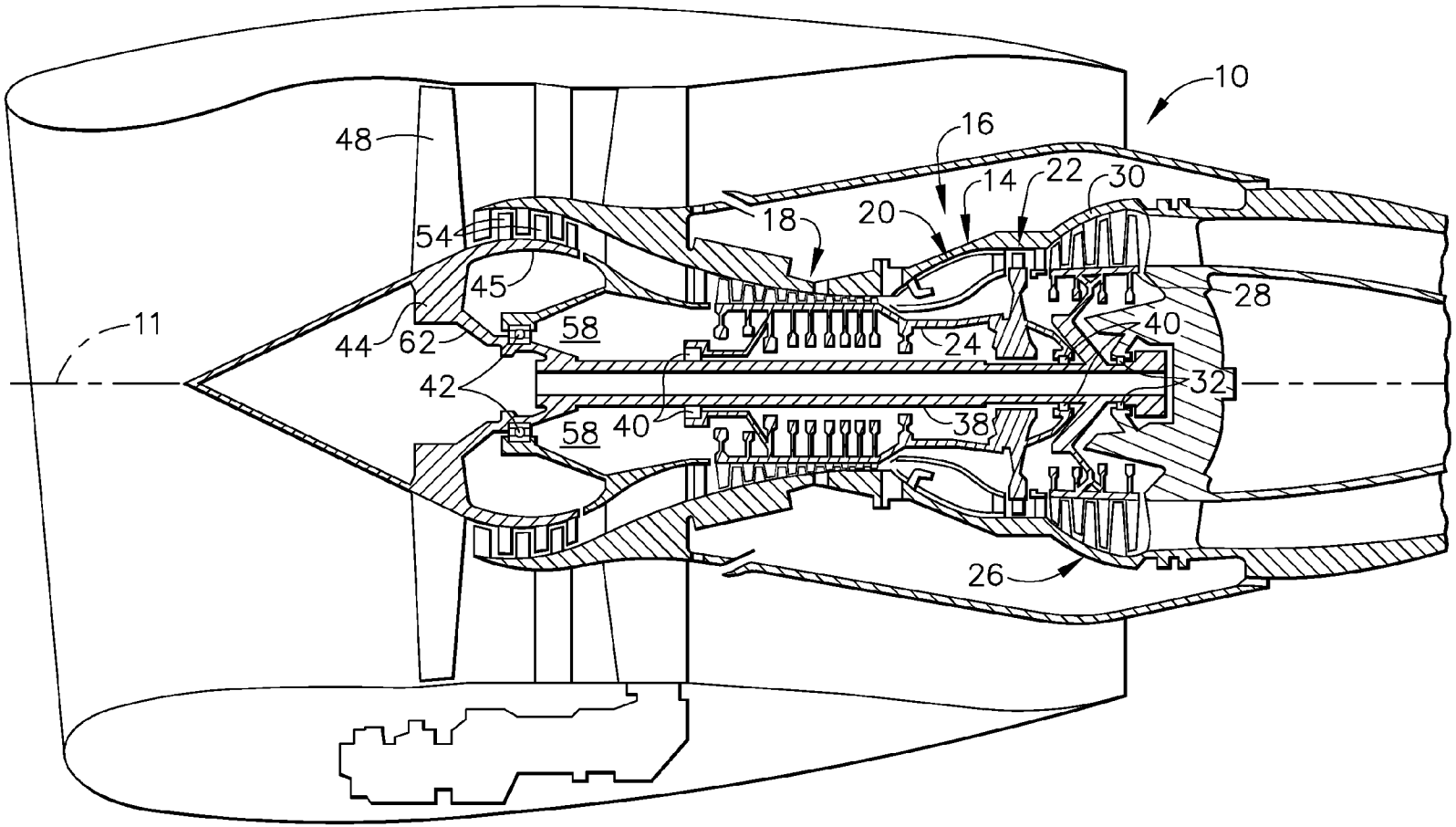
FIG. 1 is a longitudinal axial sectional view of a gas turbine engine.
Figure 3:
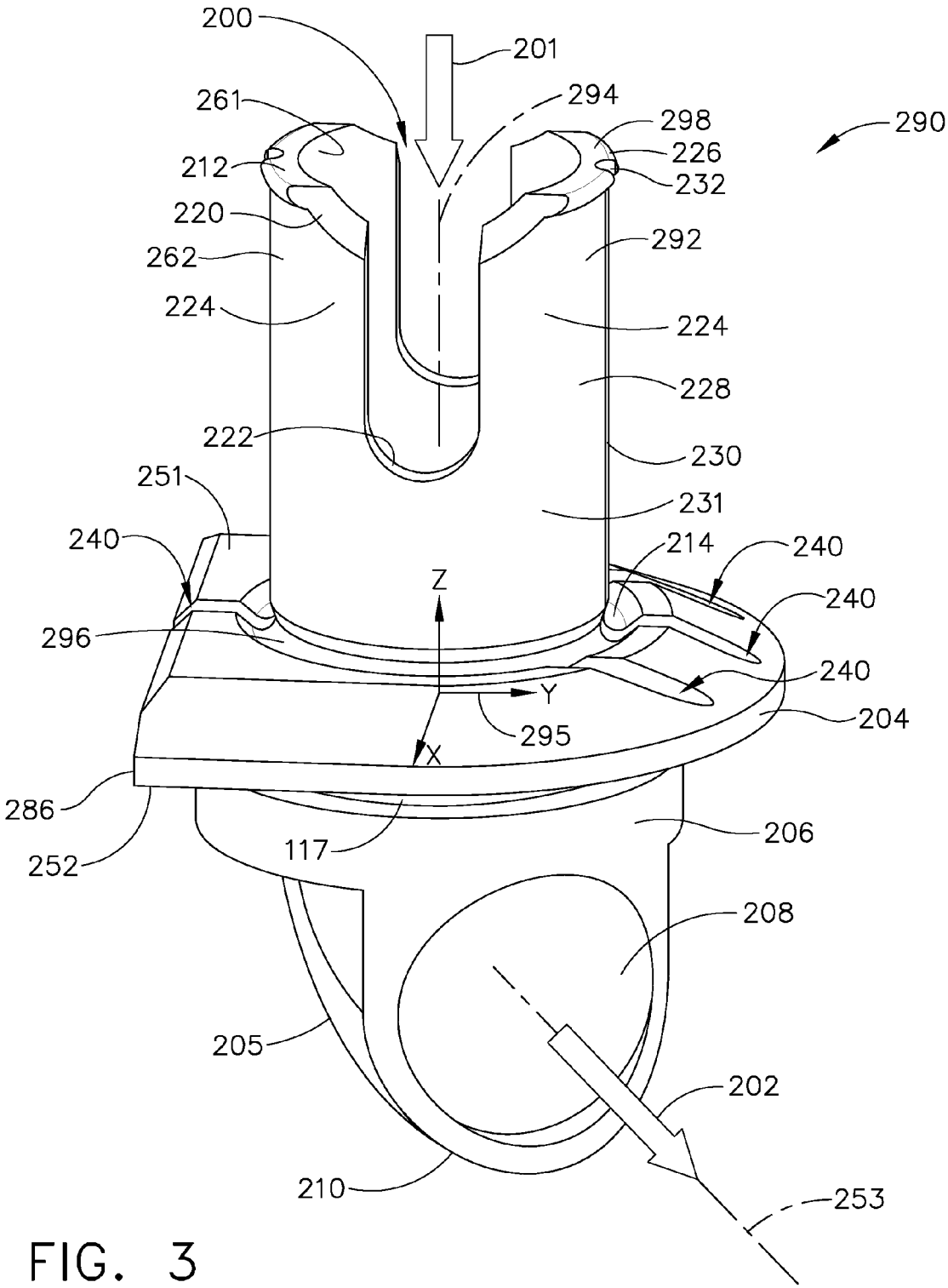
FIG. 3 is a perspective view of an exemplary embodiment of a multi-directional injector plug of the present invention.
Figure 4:
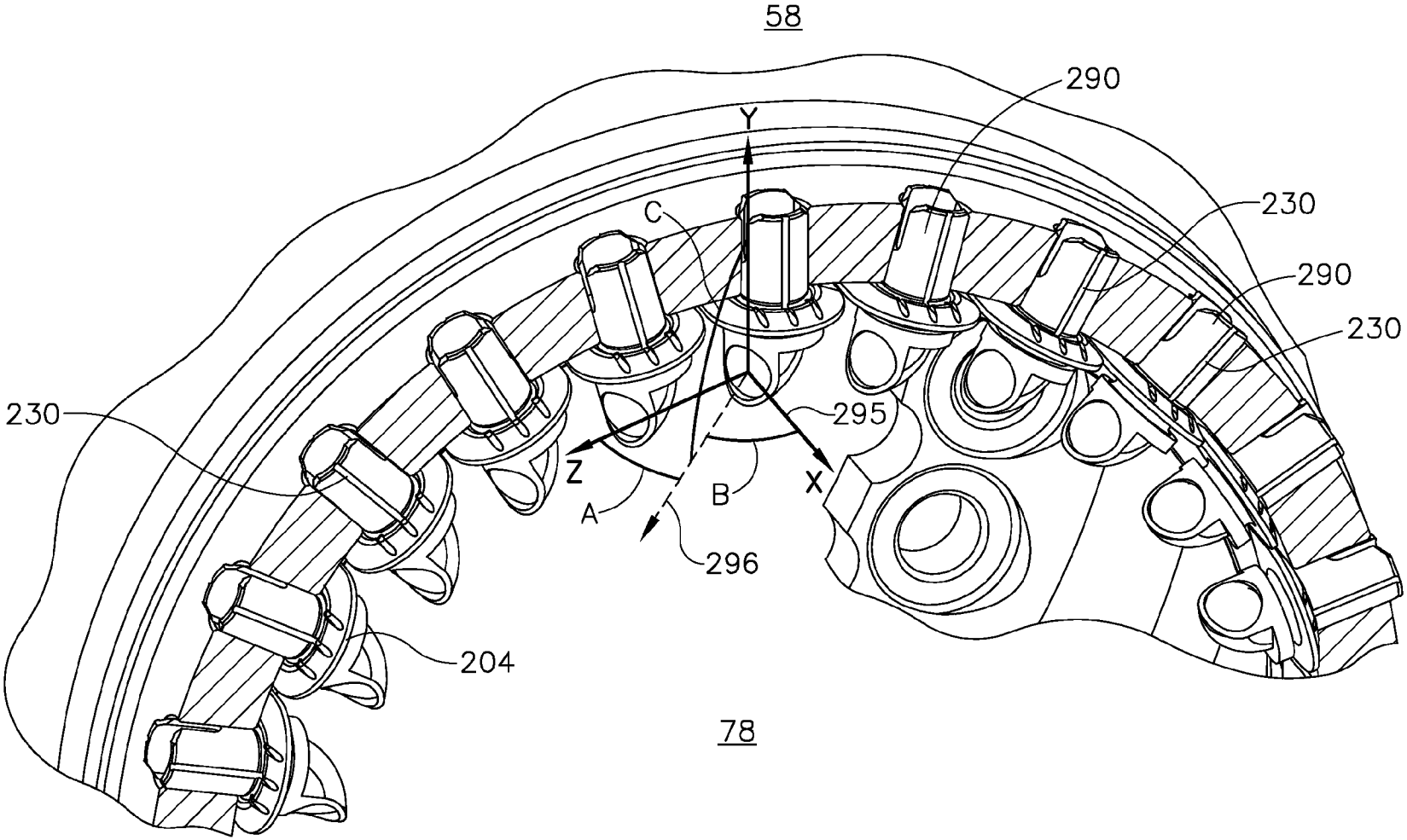
FIG. 4 is a perspective view of an arrangement of multi-directional injector plugs in an exemplary embodiment of an air-oil separator system of the present invention.
Figure 5:
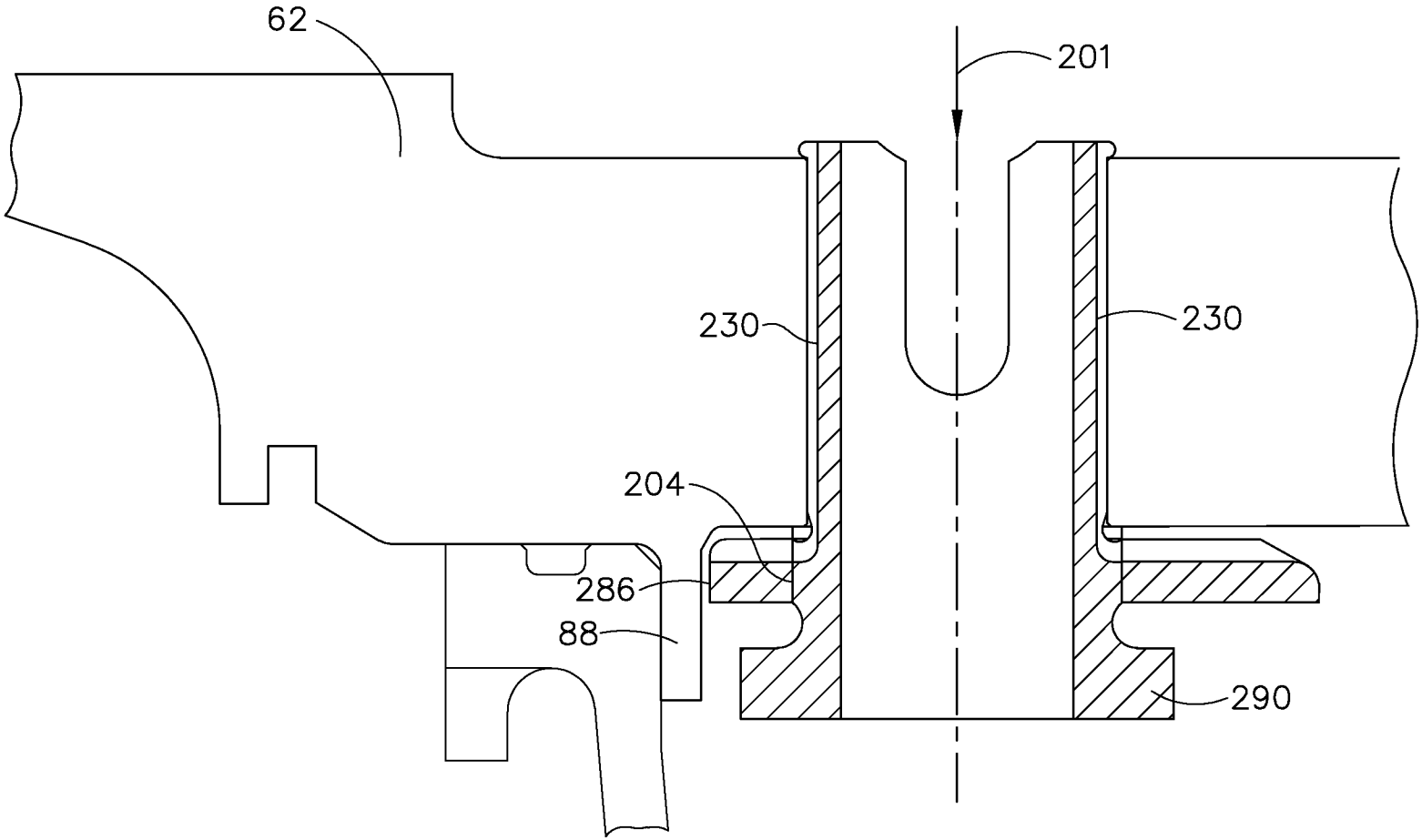
FIG. 5 is a cross-sectional view of a portion of a gas turbine engine fan forward shaft having an exemplary embodiment of a multi-directional injector plug of the present invention installed therein.

Referring to the drawings wherein identical reference numerals denote the same elements throughout the various views, FIG. 1 illustrates a gas turbine engine, generally designated 10, in which is incorporated air-oil separator system 180 of the present invention, including a multi-directional injector plug 290 as shown in detail in FIGS. 3-5. The engine 10 has a longitudinal center line or axis 11 and an outer stationary annular casing 14 disposed concentrically about and coaxially along the axis 11. The engine 10 includes a gas generator core 16 which is composed of a multi-stage compressor 18, a combustor 20, and a high pressure turbine 22, either single or multiple stage, all arranged coaxially about the longitudinal axis or center line 111 of the engine 10 in a serial, axial flow relationship. An annular outer drive shaft 24 fixedly interconnects the compressor 18 and high pressure turbine 22.

The core 16 is effective for generating combustion gases. Pressurized air from the compressor 18 is mixed with fuel in the combustor 20 and ignited, thereby generating combustion gases. Some work is extracted from these gases by the high pressure turbine 22 which drives the compressor 18. The remainder of the combustion gases are discharged from the core 16 into a low pressure turbine 26.

An inner drive shaft 38 is mounted for rotation relative to the outer drive shaft 24 via rear bearings 32, differential bearings 40, and via suitable forward bearings 42 interconnected to the outer stationary casing 14. The inner drive shaft 38, in turn, rotatably drives a forward fan shaft 62, which in turn drives a forward fan rotor 44 and, in some cases, a booster rotor 45. Fan blades 48 and booster blades 54 are mounted to the fan rotor 44 and booster rotor 45 for rotation therewith.

Figure 2:
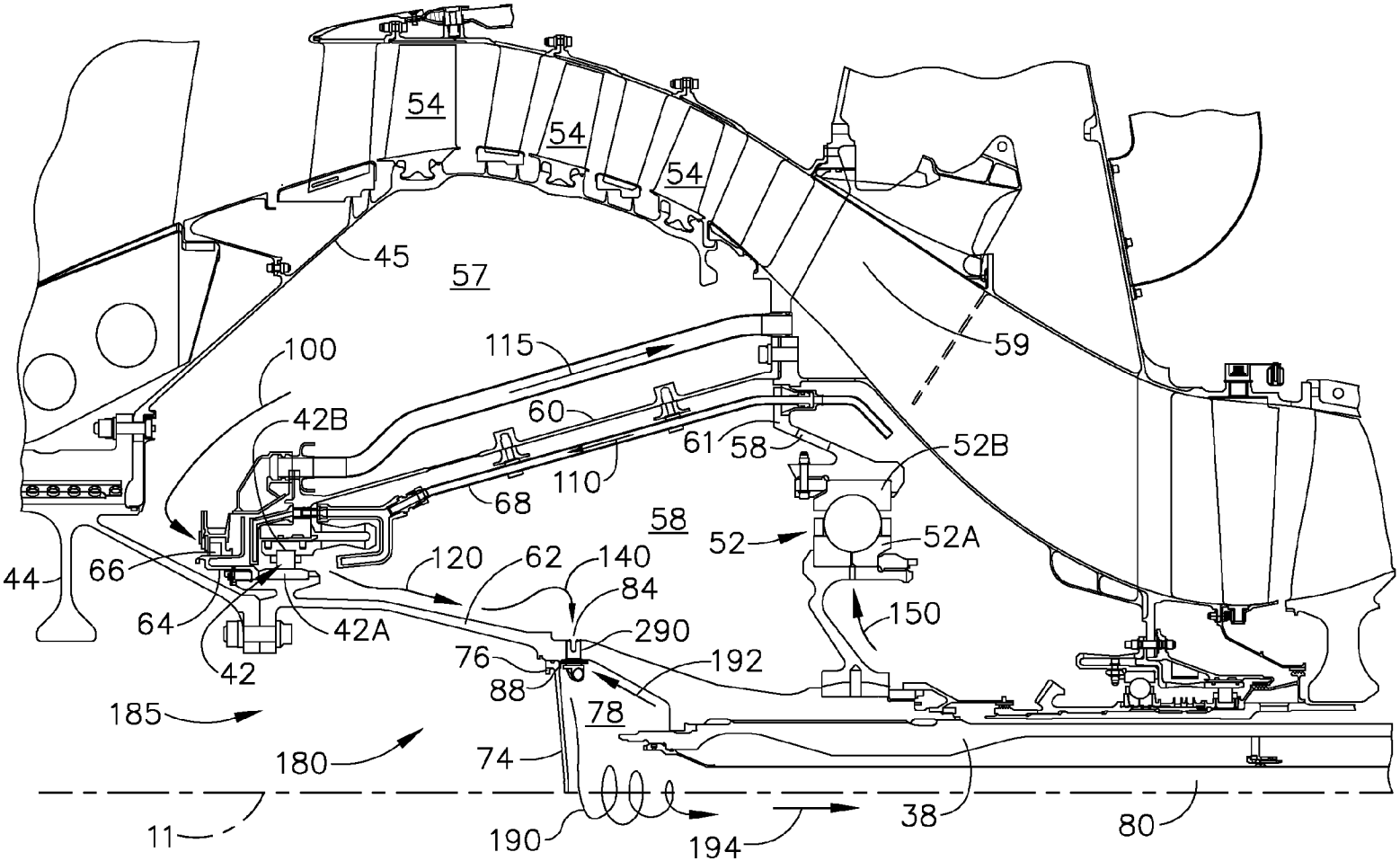
FIG. 2 is an enlarged axial sectional view of a bearing-sump region of a gas turbine engine of FIG. 1, incorporating an exemplary embodiment of an air-oil separator system of the present invention.

Referring to FIG. 2, there is illustrated the region of the gas turbine engine 10 where a bearing sump 58 is defined about the forward bearings 42. The bearing sunup 58 is generally defined by an outer annular structure 60 which is interconnected to a static frame 59 and the forward fan shaft 62 which rigidly interconnects the forward end of the inner drive shaft 38 to the forward fan rotor 44. The forward fan shaft 62, being connected with an inner annular race 42A of the forward bearings 42, rotates with the inner drive shaft 38 relative to the stationary outer annular structure 60 of the bearing sump 58 which is connected to an outer annular race 42B of the forward bearings 42.

As shown in FIG. 2, it is possible to have additional bearings 52 mounted on the forward fan shaft 62 to support the fan/booster rotors 44, 45. The inner race 52A of the bearing 52 is attached to the aft end of the forward fan shaft 62, while the outer race 52B is attached to a static support structure 61. Oil supply conduits (not shown) provide oil supply 150 to the bearing 52. Pressurized air enters the bearing sump through carbon seals 66.

Conventional circumferential labyrinth or carbon air and oil seals 64, 66 are provided adjacent to the forward bearings 42 and between the forward ends of the relatively rotating forward fan shaft 62 and the static outer annular structure 60 to seal the forward end of the bearing sump 58. Oil is pumped to the forward bearings 42 and therefore into the sump 58 through an oil supply conduit 68. Pressurized air 100 is injected to the air/oil seal 64 from a pressurized air cavity 57 which receives air from an air supply system, such as for example, the booster flow path, in order to prevent oil from leaking through the carbon seal 66.

A portion of the injected pressurized air 100 which enters the bearing sump 58 must be vented from the sump 58 in a controlled manner in order to maintain sump pressure at a proper balance. However, the pressurized air becomes mixed with particles of the oil in the sump 58. The air-oil mixture in the bearing sump 58 is shown as item 120 in FIG. 2. A significant loss of oil will occur if the air-oil mixture 120 is vented out without separating and removing the oil particles.

An exemplary embodiment of a system for reducing oil consumption in aircraft engines by separating oil from an air-oil mixture is shown in FIG. 2. The system comprises an oil supply conduit 68 through which flows an oil supply 110 into the sump. In order to prevent the leakage of oil from the system, pressurized air 100 is passed from the pressurized air cavity 57 through the seals into the sump 58. The rotating forward fan shaft 62 has one or more vent holes 84 extending through its thickness in a generally radial direction. Typically, the fan shaft 62 has a plurality of these holes 84 arranged in a band around its circumference. Multi-directional injector plugs, 290, are inserted into the vent holes 84 in the rotating shaft 62, as shown in axial sectional view in FIG. 2 and in perspective view in FIG. 4. The multi-directional injector plug 290 receives the air-oil mixture flow 140 in the radial direction through a central passage 200 and reorients the radial flow within the plug 290 towards the tangential direction and injects the air-oil mixture 140 into a separator cavity 78. In the exemplary embodiment shown in FIG. 2, the separator cavity 78 is formed within the forward fan shaft 62 bounded by a cover 74 attached to the forward fan shaft 62 with fasteners 76.

In the separator cavity 78, the rotating air/oil mixture swirls down to lower radius as it flows axially towards the air vent. This vortex swirling 190 of the air-oil mixture results in high tangential velocities and centrifugal forces acting on the air and oil particles. These centrifugal forces drive the more massive oil particles radially out (shown as item 192 in FIG. 2) to the inside diameter of the shaft 62. The separated oil particles are removed from the separator chamber 78 by means of grooves, such as those provided on the multi-directional injector plug 290. Grooves and/or holes may also be provided on the rotating shaft 62 to facilitate oil removal. The air particles are removed from the separator cavity 78 (shown as item 194 in FIG. 2) through a vent exit, such as for example shown as item 80 in FIG. 2. The preferred method of removing oil from the separator cavity 78 is by providing channels 230, 240 on the outside of the multi-directional injector plugs 290 to provide a path for oil to return to the outside diameter of the shaft 62 without being overwhelmed by the relatively high mass flow rate of air-oil mixture flowing through the inside passages of these plugs.

As discussed earlier, dwell time and tangential velocity are two important factors which determine the effectiveness of vortex separation of the oil particles from the air-oil mixture. The multi-directional injector plug 290 increases tangential velocity of the air-oil mixture entering the separator cavity 78 as well as the dwell time for tangential flow at larger radii as compared to a conventional vent hole design or one using a conventional radial plug. This is accomplished by turning the flow within the multi-directional injector plug 290 to impart a tangential component of velocity in the direction of shaft rotation as shown in FIG. 4. Thus, as the air-oil mixture flows within the multi-directional injector plug 290, it acquires additional tangential velocity, in addition to that imparted to it by the rotating shaft.

The increase in tangential velocity of the air-oil mixture flow results in a stronger vortex and higher centrifugal acceleration to separate the oil particles from the air/oil mixture in the separator cavity 78. Because the air is injected tangentially rather than radially, the air/oil mixture follows a much longer path before reaching the vortex separator exit and, therefore, the dwell time for the air/oil mixture is greater than that for conventional configurations. The new multi-directional injector plug 290 plug not only has the benefit of increasing centrifugal acceleration and dwell time but also reduces the initial inward radial momentum of the oil particles 78, thus facilitating the removal of oil particles prior to venting out.

An exemplary embodiment of the invention using multi-directional injector plugs 290 arranged circumferentially in a rotating shaft 62 is shown in FIG. 4. In FIG. 4, the X-axis shown represents the axial direction, Y-axis represents the radial direction and the Z-axis represents the tangential direction, positive in the rotational direction of the shaft 62. The multi-directional injector plug 290, described in detail below, are arranged such that each plug receives the air-oil mixture flow radially into it in the negative-Y direction and reorients the flow direction such that the flow exits the plug into the separator cavity 78 in a generally tangential direction along the direction of rotation of the shaft 62, at an angle A to the tangential axis, Z. In general the orientation angles of the stream of oil-air mixture exiting the multi-directional injector plug 290 is selected to have a tangential component with respect to the Z-axis, an axial component with respect to the X-axis, and a radial component with respect to the Y-axis. In an exemplary embodiment of the present invention, 24 plugs are used and the angle A is selected to be about 32 Degrees, and the angle B is about 58 Degrees, and angle C is about 90 degrees. While it is desired to have the angle A as small as possible, an angle of about 32 degrees is preferred so that the flow coming out of a multi-directional injector plug 290 will not impinge on the next plug immediately ahead of it in the rotational direction. As described previously, the oil particles are separated from the air-oil mixture in the separator cavity due to the vortex motion created by the rotating multi-directional injector plugs 290 and are directed radially out along the inner surface of the shaft 62 (see FIG. 2). The oil particles flow into the groove 230 on the exterior side of the plugs and enter back into the sump cavity 58. A conventional scavenge system located at the bottom of the sump (shown by item 115 in FIG. 2 for illustration purpose) removes oil from the bottom of the sump cavity for further processing before being pumped back into the bearing lubrication system.

Referring now to FIG. 3, a multi-directional injector plug 290 has a unitary body 292 having a first end 296 and a second end 298, defining an axis 294 extending therebetween. A generally cylindrical central passage 200 passes axially through the body 292 from the first end 296 to the second end 298, A platform 204 having a fiat surface 286 is disposed at the first end 296. A generally cylindrical elongated portion 231 extends between the first end 296 and a distal end 212. An annular groove 214 disposed at the junction of the elongated section 231 and the platform 204. The flat surface 286 on the platform provides a clearance space between the multi-directional injector plug 290 and other nearby structures when the multi-directional injector plug 290 is installed. A groove 117 disposed below the platform 204 provides surface for a tool to pry against when removing the multi-directional injector plug 290.

A pair of slots 222 are formed in opposite sides of the elongated portion 231. The slots 222 begin at the distal end 212 of the elongated portion 231 and extend partially down the length of the elongated section 231. The slots 222 divide the elongated section 231 into two prongs 224. Each of the prongs 224 has a pair of chamfered surfaces 220 formed at its distal end 212, on opposite sides of the prong 224. An annular protruding lip 226 extends from the distal end 212 of each of the prongs 224. Although the illustrated example shows two slots 222, it should be noted that three or more slots 222 could be formed in the elongated section 231, dividing it into three or more prongs 224. At least one weep passage 230 is formed in the outer surface 228 of the elongated section 231. The weep passages 230 are in the form of grooves having a generally semicircular cross-section, although other shapes may be used. The weep passages have an outlet 232 disposed at the distal end of the elongated section 231. The weep passages then extend axially towards the platform 204. The weep passages 230 intersect an annular groove 214 located between the elongated section 231 and the platform 204. The weep passages 230 are in flow communication with the groove 214. The platform 204 has several weep passages 240 located on the surface of the platform 204 near the first end 296 of the body 230. These weep passages 240 are in flow communication with the groove 214. These weep passages 230, 240 and the groove 214 facilitate the return of the oil separated from the air-oil mixture from the separator cavity 78.

The multi-directional injector plugs 290 has a discharge head 206 which has a bend portion 205. The discharge head bend portion 205 has an interior passage 208 through which the air-oil mixture flows prior to entering the separator cavity 78. The air-oil mixture 202 is discharged into the separator cavity 78 at the exit orifice 210. The discharge head interior passage 208 and the exit orifice 210 are suitably shaped to provide any desired orientation angles A, B and C. In the exemplary embodiment shown in FIG. 3, the discharge head interior passage 208 has a generally circular shape perpendicular to the direction of the flow in the passage. The exit orifice 210 also has a generally circular shape perpendicular to the direction of the flow at exit.

As described previously, the multi-directional injector plugs 290 introduces the air-oil mixture into the separator cavity at selected orientation angles A, B and C. It is important to ensure that during engine assembly, the multi-directional injector plugs 290 are assembled in the correct orientation. This is accomplished by providing a flat surface 286 on the side of the platform 204 as shown in FIG. 5. This flat surface 286 aligns with a flange 88 on the fan shaft 62. This feature creates interference if an attempt is made to install the multi-directional injector plugs 290 in an improper direction. Alternatively, the flat surface 286 may be located on another appropriate location of the multi-directional injector plug 290 such as on discharge head 206 or the body 292 or other suitable locations to engage with another suitable flat surface to avoid mis-assembly.

The multi-directional injector plugs 290 is manufactured from a material which is capable of withstanding the temperatures prevailing in the sump 58, which is approximately 149 Deg. C. (300 Deg. F.), and resisting attack from the engine lubricating oil. Also, because the fan shaft 62 may be a life-limited part whose characteristics must not be compromised, the multi-directional injector plugs 290 must be made of a material which will itself wear rather than cause wear of the fan shaft 62. Furthermore, the weight of the multi-directional injector plugs 290 is preferably minimized both to avoid extra weight in the engine 10 generally, and to preclude imbalance problems in the fan shaft 62. One suitable material is VESPEL polyimide, available from E.I. DuPont de Nemours and Company, Wilmington, Del. 19898 USA. Another suitable material is PEEK polyetheretherketone, which is available from Victrex USA Inc., 3 Caledon Court, Suite A, Greenville, S.C. 29615 USA. In general, any material that satisfies the requirements described above may be used, for example aluminum or other relatively soft metals may also be suitable materials. The multi-directional injector plugs 290 may be formed by any known method, for example injection molding, compression molding a near-net shape followed by machining, or by machining from a blank of material.

It has been hound that in general that oil separation efficiency for vortex separators tends to increase with oil particle size, and may approach 100% for large oil particles of 15 microns or higher. However, it has been found using conventional computational fluid dynamic analyses that that embodiments described herein are highly efficient in separating oil particles smaller than 15 microns also. For example, in an aircraft engine under cruise conditions, it has been analytically found that for an oil particle size of 10 microns, the oil separation efficiency using the present invention is more than 95% where as the oil separation efficiency using conventional techniques is less than 20%.

While the invention has been described in terms of various specific embodiments, those skilled in the art will recognize that the invention can be practiced with modification within the spirit and scope of the claims.

What is claimed is:

1. A multi-directional injector plug comprising:

a platform;

a generally cylindrical body disposed on a first side of the platform, the cylindrical body having a longitudinal axis and a wall having inner and outer surfaces wherein the inner surface defines a central passage;

a discharge head disposed on a second side of the platform, the discharge head having an exit orifice that has a central axis that is non-parallel to the longitudinal axis; and at least one weep passage disposed in the outer surface of the wall.

2. A multi-directional injector plug according to claim 1 further comprising at least one generally annular lip extending radially outwardly from the outer surface of the wall.

3. A multi-directional injector plug according to claim 1 further comprising at least two slots that divide a portion of the wall into at least two longitudinally extending prongs.

4. A multi-directional injector plug according to claim 3 wherein each of the prongs has a pair of chamfered surfaces formed on opposite sides thereof.

5. A multi-directional injector plug according to claim 1 further comprising a groove disposed between the first side of the platform and the outer surface of the cylindrical body.

6. A multi-directional injector plug according to claim 1 wherein the platform has at least one channel extending generally perpendicular to the longitudinal axis.

7. A multi-directional injector plug according to claim 1 further comprising a means for locating it in a selected angular orientation during assembly.

8. A multi-directional injector plug according to claim 1 wherein the body comprises a polymer.

* * * * *

UNITED STATES PATENT AND TRADEMARK OFFICE

CERTIFICATE OF CORRECTION

PATENT NO. : 8,443,843 B2
APPLICATION NO. : 13/617462
DATED : May 21, 2013
INVENTOR(S) : Mount et al.

It is certified that error appears in the above-identified patent and that said Letters Patent is hereby corrected as shown below:

In the Specification

Column 2, Line 67, delete “line 111” and insert -- line 11 --, therefor.

Column 3, Line 21, delete “sunup” and insert -- sump --, therefor.

Column 5, Line 33, delete “298,” and insert -- 298. --, therefor.

Column 5, Line 33, delete “fiat” and insert -- flat --, therefor.

Column 6, Line 56, delete “hound” and insert -- found --, therefor.

Signed and Sealed this
Sixteenth Day of September, 2014

Michelle K. Lee

Michelle K. Lee
*Deputy Director of the United States Patent and Trademark Office*